US005480710A

United States Patent [19]

Frankosky et al.

[11] Patent Number: 5,480,710

[45] Date of Patent: Jan. 2, 1996

[54] FIBERBALLS

[75] Inventors: Michael S. Frankosky, Hockessin, Del.; Adrian C. Snyder, Greenville, N.C.

[73] Assignee: E. I. Du Pont de Nemours and Company, Wilmington, Del.

[21] Appl. No.: 406,355

[22] Filed: Mar. 17, 1995

Related U.S. Application Data

[63] Continuation-in-part of Ser. No. 129,624, Sep. 30, 1993, abandoned.

[51] Int. Cl.[6] ..... B32B 9/00

[52] U.S. Cl. ..... 428/288; 428/359; 428/370; 428/371; 428/369; 428/395; 528/272; 528/308.6; 5/636

[58] Field of Search ..... 428/395, 394, 428/373, 357, 359, 369, 370, 374, 288, 402; 528/272, 307, 308.6; 5/636

[56] References Cited

U.S. PATENT DOCUMENTS

| | | | |
|---|---|---|---|
| 3,271,370 | 9/1966 | Akin et al. | 260/75 |
| 3,670,489 | 6/1972 | Jackson, Jr. et al. | 57/140 |
| 3,763,644 | 10/1973 | Jackson, Jr. et al. | 428/359 |
| 3,814,725 | 6/1974 | Zimmerman et al. | 260/40 |
| 3,870,590 | 3/1975 | Hurwitz | 57/140 |
| 4,129,675 | 12/1978 | Scott | 428/288 |
| 4,159,617 | 7/1979 | Allan | 428/364 |
| 4,281,042 | 7/1981 | Pamm | 428/361 |
| 4,413,030 | 11/1983 | Tesch et al. | 428/85 |
| 4,418,116 | 11/1983 | Scott | 428/288 |
| 4,618,531 | 10/1986 | Marcus | 428/283 |
| 4,783,364 | 11/1988 | Ilan | 428/288 |
| 4,794,038 | 12/1988 | Marcus | 428/288 |
| 4,818,599 | 4/1989 | Marcus | 428/288 |
| 4,837,254 | 6/1989 | Branscome | 523/455 |
| 4,908,052 | 3/1990 | Largman et al. | 55/486 |
| 4,940,502 | 7/1990 | Marcus | 156/272.2 |
| 5,069,970 | 12/1991 | Largman et al. | 428/373 |
| 5,112,684 | 5/1992 | Halm et al. | 428/357 |
| 5,154,969 | 10/1992 | Kerawalla | 428/288 |
| 5,169,580 | 12/1992 | Marcus | 264/115 |
| 5,183,708 | 2/1993 | Yoshida et al. | 428/373 |
| 5,218,740 | 6/1993 | Snyder et al. | 19/66 |
| 5,268,438 | 12/1993 | Carson et al. | 526/273 |
| 5,310,799 | 5/1994 | Carson et al. | 525/176 |
| 5,344,707 | 9/1994 | Snyder | 428/359 |
| 5,348,699 | 9/1994 | Meyer et al. | 528/272 |

FOREIGN PATENT DOCUMENTS

| | | |
|---|---|---|
| 2731108 | 1/1979 | Germany . |
| 04073217 | 3/1992 | Japan . |
| 9116485 | 10/1991 | WIPO . |

OTHER PUBLICATIONS

Eastman Textile Fibers Publication No. K–230C, Sep. 1988, "Kodel® Polyester Fibers—Fiber Types and Their Characteristics for Fiberfil Applications".

Eastman Publication K–231–F, Sep. 1992, "Fibers for Nonwovens—Kodel® Polyester Matrix Fibers for Nonwoven Fabrics—Fiber Types and Their Characteristics".

Eastman Publication No. K–305, Dec. 1991, "Eastman's Unique Fiber—Kodel® 200 Series".

*Primary Examiner*—Patrick J. Ryan
*Assistant Examiner*—J. M. Gray

[57] ABSTRACT

Fiberballs based on poly(1,4-cyclohexanedimethylene terephthalate) fiber have given improved products.

6 Claims, No Drawings

FIBERBALLS

CROSS REFERENCE TO RELATED APPLICATION

This application is a continuation-in-part of copending application Ser. No. 08/129,624, filed Sep. 30, 1993, abandoned.

FIELD OF INVENTION

This invention relates to new fiberballs, and more particularly to such containing polyester fibers of poly(1,4-cyclohexanedimethylene terephthalate) as polyester polymer, and especially such fiberballs as are moldable, on account of containing binder fibers, and their molding into new molded products, and articles, such as pillows, that are filled with such new fiberballs.

BACKGROUND OF INVENTION

Marcus in U.S. Pat. Nos. 4,618,531 and 4,794,038 disclosed new fiberballs of polyester fibers. Such fiberballs are often now referred to in the art by other terms, including "clusters"; this term "clusters" is sometimes used herein as Well as "fiberballs".

In the latter patent, Marcus disclosed the bonding of the fiberballs into molded products and other bonded products in which the polyester fibers became load-bearing fibers (sometimes called matrix fibers) that were bonded together by binder fibers. Such fiberballs have proved very useful commercially, and improvements and variations have been disclosed in U.S. Pat. Nos. 4,940,502, 4,818,599, 5,112,684, 5,154,969, 5,169,580, and 5,218,740, for example, the disclosures of which are hereby disclosed herein by reference, as are the disclosures of the aforesaid earlier Marcus patents.

It would be desirable, however, to produce such molded products with better resistance to compression/heat-set than have been available from materials available hitherto. For instance, some seating designers require cushioning materials to take an improved (i.e., numerically lower) set when tested according to ASTM 3574-D, the key test conditions of which require compression to 50% for 22 hours at 158° F. (70° C.) and allow 30 minutes of recovery time after release from such compression before the "set" is measured.

SUMMARY OF THE INVENTION

The solution to this problem according to the present invention is provided by fiberballs containing binder fibers with load-bearing fibers that consist essentially of poly(1,4-cyclohexanedimethylene terephthalate). This polymer poly(1,4-cyclohexanedimethylene terephthalate) is sometimes referred to herein as CHDMT, as opposed to 2G-T, for poly(ethylene terephthalate), which is the polyester most commonly available and used commercially for polyester fibers hitherto.

CHDMT polymer and fibers were disclosed several decades ago in U.S. Pat. No. 3,271,370 (Akin et al.) assigned to Eastman Kodak Company (of Rochester, N.Y.), and have been sold commercially (as KODEL 200 Series fiber) and their properties have been disclosed in brochures, such as K-230C, September, 1988, K-305, December, 1991, and K-231F, September, 1992.

After solving the above problem by making the present invention, we investigated the cushioning properties of similar fiberballs consisting essentially of only CHDMT, i.e., without binder fibers, and found surprising advantages in the properties of such fiberballs, as will be related.

According to a first aspect of the invention, therefore, there are provided fiberballs, of average diameter 2 to 15 mm, consisting essentially of randomly-arranged, entangled, crimped polyester fiberfill having a cut length of 10 to 100 mm, characterized in that the polyester is poly(1,4-cyclohexane dimethylene terephthalate), i.e., CHDMT, and pillows, cushions and other filled articles, in which the filling is, at least in part, such fiberballs.

According to an important second aspect of the invention, there are provided moldable fiberballs, of average diameter 2 to 15 mm, consisting essentially of randomly-arranged, entangled, crimped polyester fiberfill having a cut length of 10 to 100 mm and of randomly-arranged, entangled, crimped binder fiber, characterized in that said polyester fiberfill consists essentially of poly(1,4-cyclohexanedimethylene terephthalate), i.e., CHDMT.

Such crimped polyester fiberfill comprises load-bearing (or matrix) CHDMT polyester fibers titat are provided (according to the present invention) in the moldable fiberballs with binder fibers, such as are known in the art, and have, e.g., been disclosed by Marcus (referred to hereinbefore) or as will be discussed hereinafter.

Preferred binder fibers are bicomponent fibers, of, e.g., sheath/core or side-by-side configuration, having one component (such as the sheath) comprised of lower melting binder material, and the other component (such as the core) which may be comprised also of CHDMT so as to improve further the compression set of the resulting molded products. Preferred binder material should be heat-activatable at a temperature that is higher than 70° C. by a sufficient margin (the test temperature for ASTM 3574-D), i.e., preferred binder material should not be activated under these test conditions. Generally, it is desirable that the binder material be heat-activatable at a temperature of at least 100° C. Especially advantageous binder materials have a distinct melting point, as discussed hereinafter.

Also provided, according to other aspects of the invention, are molded products prepared by molding the new moldable fiberballs and processes for making the fiberballs and/or molded products.

DETAILED DESCRIPTION OF THE INVENTION

Much of the technology for use in the practice of the invention has already been disclosed in the literature, e.g., as mentioned in the BACKGROUND above, or elsewhere herein, and is known to those skilled in these various arts. For instance, preparation of CHDMT polymer and of fibers were disclosed almost 30 years ago in U.S. Pat. No. 3,271,370, and the CHDMT fibers used herein were purchased from Eastman companies (assignor of U.S. Pat. No. 3,271,370, and publishers of brochures mentioned above). The blending of fibers, the manufacture of fiberballs from 2G-T fibers, and the molding of fiberballs containing binder fibers have all been published in other patents, as mentioned above, as has been the provision of various types of crimp, and the preparation of 2G-T fibers has long been known and this has been practiced by many manufacturers.

Considering first the second aspect of the invention mentioned above, an essential feature is the use of load-bearing (or matrix) fibers consisting of poly(1,4-cyclohexanedimethylene terephthalate)—CHDMT, instead of 2G-T. S In other respects, the disclosures of Marcus and others in U.S.

Pat. Nos. 4,794,038, 4,940,502, 4,818,599, 5,112,684, 5,154,969, 5,169,580 and 5,218,740 may essentially be followed, in so far as concerns aspects of the invention involving fiberballs of load-bearing fibers with binder fibers, and their molding into molded products.

This aspect will now be illustrated in the following Examples, in which the load-bearing polyester fibers are often referred to as "matrix fiber", in contrast to the binder fiber, and the fiberballs are often referred to as "clusters". All references to parts, percentage, or proportions are by weight, unless otherwise indicated.

EXAMPLES 1 AND 2 AND COMPARISONS

Compression/heat-set values were measured according to ASTM 3574-D for several different molded fiberball products and are summarized in Table 1. All the molded products in Table I were prepared and molded similarly, as will be described hereinafter, from precursor moldable fiberballs having different combinations of matrix fiber and of binder fiber, as indicated in Table 1.

TABLE 1

| | Matrix Fiber | | | Binder | Molded Products | |
|---|---|---|---|---|---|---|
| Item | Polymer (1) | dpf | Crimp (2) | Fiber (3) | Density (lb/ft$^3$) | Set % |
| Examples | | | | | | |
| 1 | CHDMT (A) | 6 | M | T4080 | 2.62 | 23 |
| 2 | CHMDT (A) | 6 | M | S-74 | 2.46 | 17 |
| Comparisons | | | | | | |
| A | 2G-T (E) | 6 | S | S-74 | 2.00 | 30 |
| B | 2G-T (E) | 6 | s | T4080 | 2.25 | 34 |
| C | 2G-T (B) | 4.25 | M | T4080 | 2.56 | 32 |
| D | 2G-T (C) | 6 | S | T4080 | 2.44 | 36 |
| E | 2G-T (D) | 13 | S | T4080 | 2.44 | 36 |
| F | 2G-T (D) | 13 | S | T2080 | 2.56 | 29 |

It will be seen that the % set values for fiberballs of CHDMT polymer according to the invention (Examples 1 and 2) were significantly better (i.e., lower) than for those of 2G-T (Comparisons A–F).

Notes (for Table 1, above, and for Table 2, below)

(1) Matrix polymer types—all 2-inch cut length fibers, except for (C):CHDMT (A)—from 1,4-cyclohexanedimethanol and terephthalic acid— KODEL® Series 211, purchased from Eastman Fibers (used for Examples 1 and 2 and Item P)

2G-T - all from ethylene glycol and terephthalic acid.

2G-T (B) - DACRON® T-808, polyester fibers available from DuPont (used for Comparisons C and X)

2G-T (C) - Not a commercial fiber but similar to DACRON® T-88 available from Du Pont de Nemours International S.A. in Europe—cut length 1.25 inches (used for Comparison D)

2G-T (D) - H38F, 13 denier, purchased from Unitika (used for Comparisons E, F and Z)

2G-T (E) - H38F, 6 denier, purchased from Unitika (used for Comparisons A, B and Y)

(2) Crimp-types

M=Mechanical;

S=Spiral (sometimes termed helical).

(3) Binder-types

All the binder fibers were concentric sheath/core binder fibers, containing a core of 2G-T surrounded by a sheath of binder material, and were purchased from Unitika Ltd. (4-1-3, Kyutaro-machi, Chuo-ku, OSAKA, 541, Japan). Types 4080 and 2080 have a binder material sheath of 2G-T/2G-I copolymer, but with different proportions of 2G-I, so the binder material copolymers are heat-activatable at different temperatures, about 110° C. in the case of T4080 and about 210° C. in the case of T2080. S-74 has a sheath of a new binder material that has not been disclosed by Unitika, but has a distinct melting point (158° C.), so is believed to be crystalline in contrast to the other binder materials which are not crystalline and do not have distinct melting points, but soften to act as binder materials at about the temperatures indicated. All these binder fibers are believed to contain about 50/50 proportions sheath/core. Each of the T-4080 and S-74 were of about 4 dpf, while the T-2080 was about 2 dpf.

For each Item in Table 1, the blended fibers were formed into fiberballs (clusters) according to the procedures described in Snyder, U.S. Pat. No. 5,218,740, from 80/20 blends (by weight) of the matrix fibers and of the binder fibers, as described in Table 1.

To obtain blends of the binder fiber with the matrix fiber, each of the binder fiber and matrix fiber were charged to separate hopper feeders equipped with calibratable weigh pans. The weigh pans were calibrated to discharge amounts to provide the required weight % in each of the blends. The products discharged from weigh pans fell onto an endless conveyor in such a manner that the lower % component was discharged on top of the higher % component. This endless conveyor supplied a blending roll, which, in turn, fed the product to an air convey system. The air convey system fed the blend to another hopper/feeder which metered the product to the fiber opening unit (Kirschner beater). All blend preparation and opening equipment were commercial units (available from Hollingsworth).

The opened staple fibers were then air-conveyed to feeding equipment which supplied a controlled amount of the fiber to a modified roller top card modified as described by Snyder et al. in U.S. Pat. No. 5,218,740 to make fiberballs.

The molded part was shaped like a cylinder with a 10-inch (25 cm) diameter and a 4-inch (10 cm) height. The entire mold was constructed from perforated steel sheets with ⅛ inch (3.2 mm) holes placed at 3/16 (4.8 mm) inch centers such that there was about 40% openness. To make molded parts with about a 2.5 lb/ft$^3$ (40 Kg/m$^3$) density, the cylinder was charged with 0.182 pounds (82 grams) of clusters. A perforated steel plate secured the loose clusters to form a 4-inch (10 cm) tall cylinder. The mold, with its charge of clusters, was inserted into ductwork arranged inside an oven to force recirculated heated air through the mold from the bottom to the top. The air pressure was adjusted to between 0.5 and 0.75 inches (12 and 19 mm) water. For Items 1 and B-E (using T4080 binder fiber) the air was heated to 180° C., and the sample was removed after one to two minutes when the temperature of the air downstream of the mold reached 170° C. For Item F (using T2080 binder fiber), the air was heated to 220° C., and the sample was removed when the temperature of the air downstream reached 210° C. For Items 2 and A (using S-74 binder fiber), the air was heated to 200° C., and the sample was removed when the temperature of the air downstream reached 180° C. Not all the molded products were exactly 4-inches (10 cm) in height when removed from the mold, so the densities reported in the Table were calculated from the actual sample heights.

Since the binder fibers used for Examples 1 and 2 above contained a 2G-T core, undesired compression heat/set behavior could be expected as experienced from 2G-T matrix fibers; in other words, the presence of 2G-T could be expected to raise the compression heat/set values. Also, the 2G-T/2G-I polymer binder material in the sheaths might soften at the compression heat/set test temperature and contribute to some or all of the heat/set by allowing the bond points to become mobile. So fiberfill clusters in Table 2 were made without such binder fiber and were molded by being bonded with AEROTEX® M3, a melamine formaldehyde thermoset resin, whose properties are known to be relatively insensitive to temperature. The clusters were made essentially as described below for the clusters whose properties are given in Table 3 below. As indicated, for Table 2, bonding was achieved with melamine formaldehyde resin, AEROTEX® M3 (made by and purchased from American Cyanamid). A solution was prepared as follows: 18.4 g of AEROTEX® M3, 5.9 g of Accelerator MX, and 168 g of water. This solution was intimately mixed with 59 g of clusters, then allowed to drain. The wet clusters were then charged into a solid wall canister with a 6-inch (15 cm) diameter. A screen fixed the loft of the wet clusters at 4-inches (10 cm). After 20 minutes in an air recirculation oven at 163° C. (325° F.), the molded parts were dried and cured. The compression/heat set values of the molded products were measured and are given in Table 2.

TABLE 2

| | Matrix Fiber | | | | Molded Products | |
|---|---|---|---|---|---|---|
| Item | Polymer (1) | dpf | Crimp (2) | Binder (3) | Density (lb/ft$^3$) | Set % |
| P | CHDMT (A) | 6 | M | AM3 | 2.81 | 17 |
| X | 2G-T (B) | 6 | M | AM3 | 2.56 | 33 |
| Y | 2G-T (E) | 6 | S | AM3 | 2.36 | 30 |
| Z | 2G-T (D) | 13 | S | AM3 | 2.49 | 35 |

MS3=AEROTEX® M-3-melamine formaldehyde resin purchased from American Cyanamid Company (see Notes after Table 1 for other items).

Whether bonded with binder fiber or with thermoset resin, the CHDMT clusters had consistently lower heat/set than 2G-T clusters. Moreover, the lowest heat/set data were obtained (1) when 2G-T polymer was totally excluded from the fiber system (Item P) and (2) when S-74 binder fiber was used (Example 2). Comparing Comparison Item A with Comparison Item B shows using S-74 vs. T4080 reduced the set somewhat (to 30 from 34) when 2G-T was the matrix fiber (similarly to using AM3 as binder in Item Y in Table 2). Use of CHDMT, however, as in Examples 1 and 2, reduced the set much more significantly, even when T4080 was used as binder fiber. The added advantage of S-74 vs. T4080 with CHDMT as matrix fiber was much less than when 2G-T was used as matrix fiber, as can be seen, and this is believed to have been because the set was already low with CHDMT as matrix fiber (80% of such blends).

As already indicated, the binder material preferably has a distinct melting point. Such melting point is preferably at least 20° C. below the melting point of the matrix fiber (which comprises CHDMT). As indicated also, however, preferred molded products may also be made using a binder fiber with binder material of softening temperature high enough to resist softening during testing for compression/heat-set testing (for example under ASTM 3574-D), and/or using CHDMT polymer both for the matrix fiber and for the core of a sheath/core bicomponent binder fiber.

As indicated, reference may be made to the art, such as the Marcus patents, for further details, e.g., the amounts of binder fibers, which will depend on the specific application, but will generally be about 10—30% by weight of the total weight of fibers.

EXAMPLE 3 AND COMPARISONS

Reverting to the first aspect of the invention, fiberballs (clusters) were made essentially similarly as described above, except that they contained no binder, i.e., were 100% polyester fiberfill (2-inch cut length) of various types of polyester polymer, and certain properties were measured and are given in Table 3.

The CHDMT fiber was KODEL® 211 (6 dpf, solid round fiber, 2-inch cut length, same as item A used in Tables 1 and 2). Crimps per inch (CPI) were analyzed to be 5.6 according to the method described in U.S. Pat. No. 5,344,707. One 2G-T fiber used was DACRON® T-808 (6.5 dpf, single hole hollow fiber, 2-inch cut length, same as item B used in Tables 1 and 2 above). Whereas item B was "dry", i.e. not coated with a silicone slickener, a commercial product (DACRON® T-234, 4.25 denier, 1.25-inch cut length, slickened), designated as "item X", was also made into clusters by the same process for comparison.

The staple fiber was fed to a hopper/feeder (a commercial unit from Hollingsworth-on-Wheels in Greenville, S.C.) which began the fiber opening operation. The fiber was then air-conveyed to another hopper/feeder which metered the product into the fiber opening unit (Kirschner beater), also commercial units available from Hollingsworth. The opened staple fibers were then air-conveyed to feeding equipment which supplied a controlled amount of the fiber to a modified roller top carding unit as described by Snyder et al. in U.S. Pat. No. 5,218,740 to make clusters.

The clusters were subjected to comparative bulk measurements and tested for softness by a standard procedure as follows.

A 300-gram sample of clusters is charged into a cylinder with a height of 375 mm and an inside diameter of 292 mm. The cylinder is fitted with a circular foot with a 286 mm diameter that is affixed to a Lloyd Instrument Model #LRSK to provide a record of the stress/strain (load vs height) characteristics of the sample while it is being compressed at 508 mm/min. The sample is pre-compressed to 355 mm. Then during a second cycle, the thickness of the samples is recorded at 0.75, 5.0, 88.5, and 121.5 Newtons force. Of special importance and practical use is the measurement at 88.5 Newtons. Such heights are given in mm, with the standard deviations in parentheses, in Table 3.

TABLE 3

| | CHDMT (A) | 2G-T DRY (B) | 2G-T SLICK (X) |
|---|---|---|---|
| 0.75 N | 30.7 | 30.0 | |
| 5 N | 25.0(0.5) | 26.7(0.8) | 24–26 |
| 88.5 N | 7.6(0.2) | 11.4(0.3) | 6–7 |
| 121.5 N | 5.7(0.1) | 9.4(0.2) | 4.5–5 |

Table 3 shows that the clusters of CHDMT (A) and 2G-T (B) made equivalently lofty fillings, e.g., for pillows (values at 0.75N and 5N), but the CHDMT clusters gave significantly lower values at 88.5N and 121.5N, to an extent heretofore achieved by use of silicone slickeners, as shown by the values in Table 3 for slickened 2G-T (item X). This was very surprising. An important advantage of CHDMT clusters is their reduced sensitivity to flammability, as compared with clusters made from commercial, silicone-slickened 2G-T fiber. Thus it was surprising to get from unslickened fiber clusters (of CHDMT fiber) similar aesthetics to those obtainable only from slickened fiber clusters (of 2G-T fiber). Unslickened fiberfill is often referred to in the art as "dry".

The fact that the heights for CHDMT (A) (a dry fiber) were lower than for 2G-T dry (B) at 88.5N and at 121.5N was particularly surprising in view of the relative cohesion values of the clusters (measured as described by Marcus, e.g., in U.S. Pat. No. 4,618,531) and the relative staple pad friction values (SPF, measured as described hereinafter), even more so when one considers the relative viscosity (LRV) values.

The LRV for the KODEL™ 211 CHDMT polymer fibers was measured before finish extraction (at 25.7 LRV) and after extraction (at 28.4 LRV). This was at least 20% higher than the LRV of 20.4 for DACRON® T-808 (which is similar to that for the other DACRON® fibers used herein).

The cohesion for the CHDMT (A) clusters was measured at 11.1N, much higher than 9.6N, measured for the dry 2G-T (B) clusters, whereas the SPF is lower, as can be seen in Table 4.

Table 4 gives BL1, BL2 and SPF data for two types of CHDMT fibers—(A) were exactly as above, for Table 3—(AW) were washed in methanol to remove finish—and for 2G-T dry fiber (B), also as for Table 3 (T-808)—and for a different slickened 2G-T fiber (Y), being DACRON® T-213. Three samples were measured for each item. One should note that BL2 values (Height in inches at 0.2 psig load [0.3N/cm$^2$]) for the CHDMT fiber were nearer the level of those for silicone-slickened 2G-T fiber than for dry 2G-T fiber.

TABLE 4

| Property | CHMDT (A) | CHMDT (AW) | 2G-T Dry (B) | 2G-T Slick (Y) |
|---|---|---|---|---|
| BL1 | 5.02 | 5.19 | 5.68 | 5.57 |
| BL2 | 0.41 | 0.45 | 0.88 | 0.49 |
| SPF | 0.41 | 0.435 | 0.58 | 0.30 |

The staple products were carded for these measurements under the same processing conditions.

BL1 and BL2 values are bulk heights in inches measured under pressures of 0.001 psi and of 0.2 psi, respectively, using the TBRM (total bulk range measurement) test procedure described in Tolliver U.S. Pat. No. 3,772,137. The BL2 value is often referred to as "Support Bulk".

Fiber-to-fiber friction values for fiberfill filling (staple) fibers are generally obtained by what is known as Staple Pad Friction (SPF) measurements.

As used herein, a staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass).

The staple pad is prepared by carding the staple fibers (using a SACO-Lowell roller top card) to form a batt which is cut into sections, that are 4.0 ins in length and 2.5 ins wide, with the fibers oriented in the length dimension of the batt. Enough sections are stacked up so the staple pad weighs 1.5 g. The weight is of length (L) 1.88 ins, width (W) 1.52 ins, and height (H) 1.46 ins, and weighs 496 gm. The surfaces of the weight and of the base that contact the staple pad are covered with Emery cloth (grit being in 220–240 range), so that it is the Emery cloth that makes contact with the surfaces of the staple pad. The staple pad is placed on the base. The weight is placed on the middle of the pad. A nylon monofil line is attached to one of the smaller vertical (W×H) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/min. The staple pad, the weight and the pulley are also moved down with the base, which is mounted on the lower crosshead. Tension increases in the nylon monofil as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the Emery cloth at the interfaces with the staple pad, there is little relative motion at these interfaces; essentially any motion results from fibers within the staple pad moving past each other.) The threshold force level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

To summarize, we have found surprising and significant advantages in the compression properties of pillows filled with CHDMT fiberballs, as contrasted with 2G-T, and, in particular a surprising combination of reduced sensitivity to flammability with improved aesthetics (characteristic previously obtained only from slickened 2G-T, slickening of which has increased sensitivity to flammability of 2G-T). Accordingly, pillows, cushions and other articles filled with such new fiberballs alone, or mixed with other filling material, are expected to be very aesthetically desirable, and to have other advantages, as aforesaid.

We claim:

1. Fiberballs, of average diameter 2 to 15 mm, consisting essentially of randomly-arranged, entangled, crimped polyester fiberfill having a cut length of 10 to 100 mm, characterized in that the polyester is poly (1,4-cyclohexanedimethylene terephthalate).

2. Moldable fiberballs, of average diameter 2 to 15 mm, consisting essentially of randon-fly-arranged, entangled, crimped polyester fiberfill fibers having a cut length of 10 to 100 mm, and of binder fibers, characterized in that said polyester consists essentially of poly(1,4-cyclohexanedimethylene terephthalate).

3. Fiberballs according to claim 2, wherein said binder fibers are bicomponent binder fibers.

4. Fiberballs according to claim 2, wherein said binder fibers comprise a binder material with a distinct melting point that is at least 20° C. below the melting point of poly(1,4-cyclohexanedimethylene terephthalate) and that is at least 100° C.

5. Fiberballs according to claim 3, wherein said binder fibers comprise a binder material with a distinct melting point that is at least 20° C. below the melting point of poly(1,4-cyclohexanedimethylene terephthalate) and that is at least 100° C.

6. Pillows filled with fiberballs according to claim 1.

* * * * *